United States Patent [19]

van Heuven et al.

[11] 4,052,683

[45] Oct. 4, 1977

[54] MICROWAVE DEVICE

[75] Inventors: Johannes Hendrik Cornelis van Heuven; Frans Christiaan De Ronde, both of Eindhoven, Netherlands

[73] Assignee: U.S. Philips Corporation, New York, N.Y.

[21] Appl. No.: 735,320

[22] Filed: Oct. 26, 1976

Related U.S. Application Data

[63] Continuation of Ser. No. 549,935, Feb. 14, 1975, abandoned.

[30] Foreign Application Priority Data

Feb. 28, 1974 Netherlands ..... 7402693

[51] Int. Cl.[2] ..... H01P 1/16; H01P 5/10

[52] U.S. Cl. ..... 333/21 R; 333/26; 333/33; 333/84 M

[58] Field of Search ..... 333/21 R, 33, 35, 26

[56] References Cited

U.S. PATENT DOCUMENTS

| | | | |
|---|---|---|---|
| 3,462,713 | 8/1969 | Knerr | 333/21 R |
| 3,483,489 | 12/1969 | Dietrich | 333/21 R |
| 3,518,579 | 6/1970 | Hoffman | 333/21 R |
| 3,732,508 | 5/1973 | Ito et al. | 333/21 R |

*Primary Examiner*—Paul L. Gensler
*Attorney, Agent, or Firm*—Frank R. Trifari

[57] ABSTRACT

A microstrip waveguide transition where the substrate is arranged in a symmetry plane of waveguide and is situated parallel to the field lines of the electrical field and the longitudinal axis of the waveguide. The asymmetric microstrip conductor structure is coupled, via a symmetrical-asymmetrical transformer, to symmetric band line provided on the substrate. To be conductive for RF energy, the individual conductors of the band line are connected to opposite walls of the waveguide via broadening conductors.

3 Claims, 3 Drawing Figures

MICROWAVE DEVICE

This is a continuation of application Ser. No. 549,935, filed Feb. 14, 1975, now abandoned.

The invention relates to a microwave device for adapting a waveguide structure to a microstrip conductor structure, comprising a waveguide, a substrate which is situated in a symmetry plane of the waveguide and which is arranged parallel to the electrical field lines and in the longitudinal direction of the waveguide, the said substrate being provided on one side with a conductive base plate and with a strip-like conductor structure on the other side opposite the base plate, the said strip-like conductor structure constituting, in conjunction with the substrate and the conductive base plate, the microstrip conductor structure, the substrate furthermore being provided on both sides with a symmetrical conductor structure which is coupled to the microstrip conductor structure.

A microwave device of this kind in which the symmetrical conductor structure is a dipole antenna arranged halfway between the waveguide wall portions is known for U.S. Pat. No. 3,518,579. It was found in practice that the microwave device described in this Specification has a comparatively narrow band and that substantial reflection occurs upon transmission of energy from the microstrip conductor structure to the waveguide structure.

The invention has for its object to mitigate the said drawbacks and to realize a broadband microwave device of the kind set forth, in which the energy transmission is optimum in both directions.

The device according to the invention is characterized in that the symmetrical conductor structure is coupled to the microstrip conductor structure via a symmetrical-asymmetrical transformer.

The invention is based on the recognition of the fact that the poor transmission of energy from the microstrip conductor structure to the waveguide structure in the microwave device known from the said United States Patent Specification is due to the fact that the microstrip structure is in principle an asymmetrical waveguide structure, while the waveguide structure is a symmetrical waveguide structure. Consequently, if the step according to the invention were not taken, 50% of the energy present in the microstrip structure would be reflected at the transition between microstrip and waveguide upon transmission to the waveguide structure.

A particularly advantageous embodiment of the device according to the invention is characterized in that the symmetrical conductor structure comprises a band conductor which is arranged substantially in the longitudinal direction of the waveguide and which is connected on one end to the symmetrical-asymmetrical transformer, on the other end one of the conductors of the band conductor being coupled, via a gradually broadening first conductor, to one wave guide wall portion, the other conductor being coupled, via a second gradually broadening conductor, to a second waveguide wall portion situated opposite the first waveguide wall portion.

This offers the advantage that the said broadening conductors produce a gradual field shift and adaptation, thus resulting in a large bandwidth and less critical proportioning and positioning, so that the device can be readily reproduced.

The invention and its advantages will be described in detail hereinafter with reference to the figures, corresponding parts being denoted by the same references in the various figures.

Figure 1:
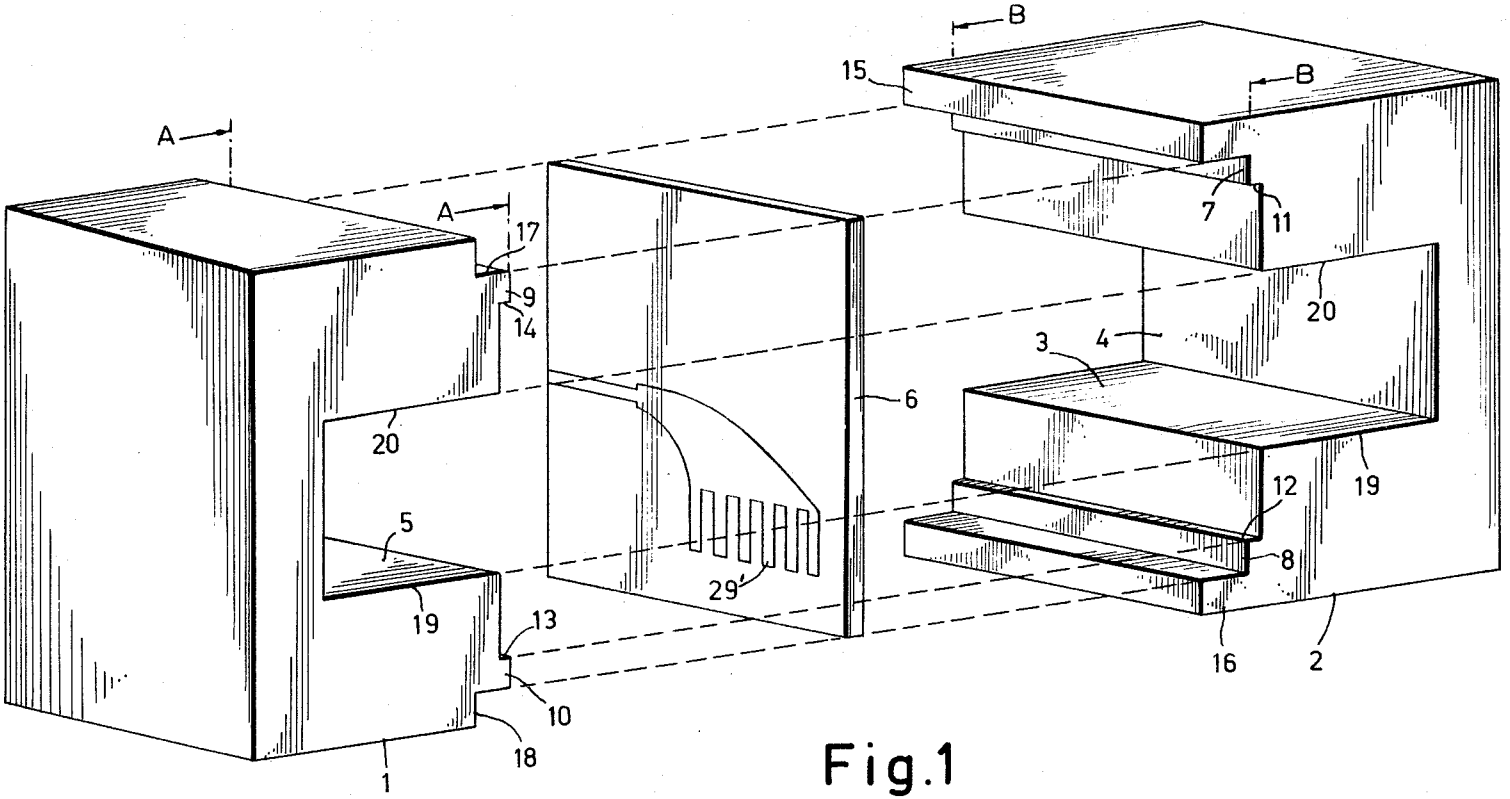
FIG. 1 is a perspective view of a microwave device according to the invention, in which the various parts constituting the device are separately shown for the sake of clarity.

The microwave device shown in FIG. 1 comprises a rectangular waveguide which is obtained from two blocks of conductive material 1 and 2 by milling. The faces of these blocks 1 and 2 which are visible in the figure and which form the walls of the waveguide are denoted by 3, 4 and 5.

The interface between the blocks 1 and 2 is formed by a symmetry plane of the waveguide which is parallel to the electrical field lines and the longitudinal axis of the waveguide.

Arranged in the symmetry plane is a substrate 6 of, for example, dielectric or gyromagnetic material which is clamped between the blocks 1 and 2 in the assembled condition of the device. The substrate 6 is notably clamped between the ridges 7 and 8 and the shoulders 9 and 10. In combination with the shoulders 9 and 10, the ridges 7 and 8 form slots which are stepwise broadened by the ridges 11, 12, 13 and 14 on the side facing the lower and the upper wall 19 and 20 of the waveguide, and which are closed in the assembled condition on the side opposite thereto by the shoulders 15 and 16 which fit in the ridges 17 and 18.

In order to clarify the positions of the blocks 1 and 2 and the substrate 6 with respect to each other in the assembled condition, FIG. 1 shows a number of broken lines along which the parts must be slid towards each other during the assembly of the device.

Figure 2:
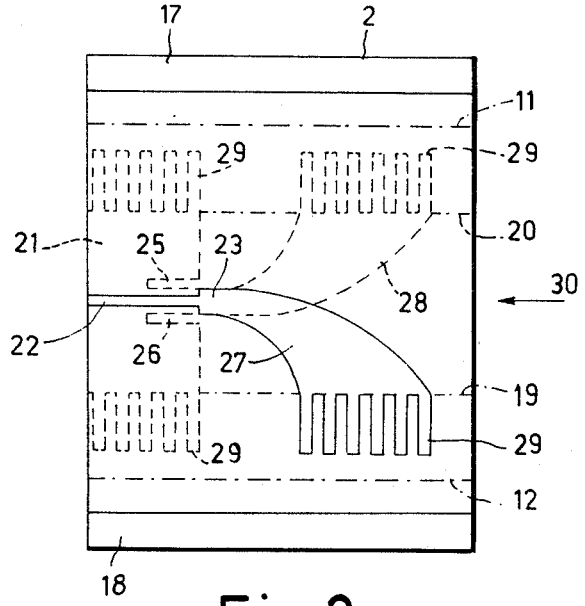
FIG. 2 is a sectional view of the microwave device taken along the line A—A in FIG. 1.
Figure 3:
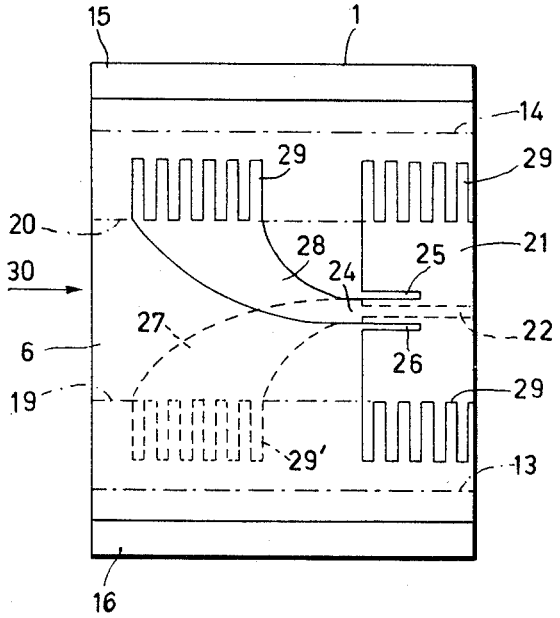
FIG. 3 is a sectional view of the microwave device taken along the line B—B in FIG. 1.

The substrate 6 is provided on both side faces with a conductor pattern which is obtained by vapour-deposition of metal or by etching away the metal layers originally covering both side faces completely. These conductor patterns will be described in detail with reference to the sectional views A—A and B—B of FIG. 1 which are shown in FIGS. 2 and 3. In these Figures the conductor patterns 29 situated on the front side of the substrate 6 are represented by uninterrupted lines, and the conductor patterns 29 situated on the rear side of the substrate 6 of FIG. 1 are denoted by broken lines. Furthermore, the locations of the ridges 11, 12, 13 and 14 and the lower and the upper wall 19 and 20 of the waveguide, all situated behind the substrate, are denoted by stroke-dot lines.

The conductor patterns comprise a conductive base plate 21 which is provided on one side of the substrate 6 (FIG. 3) and which extends between the lower wall and the upper wall 19 and 20 of the waveguide. Together with the strip-like conductor 22 provided on the opposite side (FIG. 2), halfway between the lower wall and the upper wall 19 and 20, this base plate 21 constitutes a microstrip conductor structure. It is to be noted that an extended microstrip conductor structure may be situated within the prolongation of the waveguide, or it the waveguide is not extended in the said directions, the microstrip conductor structure then may be extended outside the waveguide, or the lower wall and the upper wall 19 and 20 may be provided with a wide slot through which the microstrip conductor structure projects.

A problem exists in the optimum coupling of the microstrip conductor structure to the waveguide structure.

According to the invention, this optimum coupling is achieved in that a band conductor is provided which is arranged in this embodiment, for example, halfway between the lower and the upper wall 19 and 20 of the waveguide on both sides of the substrate 6 in the longitudinal direction of the waveguide, the said band conductor comprising first and second conductors portions 23 and 24. This band conductor is connected on one end, via a symmetrical-asymmetrical transformer, formed by approximately ¼ λ long slots 25 and 26 provided in the base plate 21 and by the strip-like conductor 22 facing the base plate 21 between the two slots 25 and 26. Furthermore, on the other end of the band first conductor portion the conductor 23 is connected-to be conductive for RF energy-to the lower wall 14 of the waveguide by means of a first broadening conductor 27 provided on the substrate, the second conductor portion 24 being connected-to be conductive for RF energy-to the upper wall 20 of the waveguide via a second broadening conductor 28, the broadening conductors 27 and 28 in this embodiment being each other's mirror image with respect to the centre line of the band conductor. It is to be noted that the band conductor portions 23, 24 need not extend parallel to the lower and the upper wall of the waveguide and may be situated at any arbitrary distance from these walls. If the situation of the band conductor deviates from that shown in the figures, the shape of the broadening conductors 27 and 28 should also be adapted, and then they no longer form each other's mirror image.

The connection which is conductive for RF energy and which is situated between the conductors 27 and 28 and the lower wall and the upper wall 19 and 20 of the waveguide is realised by means of serrated conductor configurations 29 and 29' the height of the teeth of which amounts to approximately one quarter of the wavelength at the operating frequency of the device. These tooth-shaped conductor configurations 29 and 29' are situated in the slots 7, 8, 9 and 10 of the waveguide in its assembled condition, galvanic contact between the conductor configurations 29 and 29' and the blocks 1 and 2 being prevented by the fact that the slots 7, 8, 9 and 10 are broadened by means of the ridges 11, 12, 13 and 14 and that the depth of the slots exceeds the height of the teeth. The teeth of the conductor configurations 29 and 29' constitute ¼ λ transformers which are open on one end. This means that they constitute a short-circuit at the area of the lower wall and the upper wall 19 and 20 of the waveguide. Because of this construction it is achieved that proper RF contact is ensured also if assembly position of substrate 6 in the waveguide deviates slightly from the ideal position.

It is to be noted that other constructions can alternatively be used, for example, a substrate which is clamped between the lower and the upper wall of a non-divided waveguide, the said conductive connections then being realized by means of soldering, or the ridges 11, 12, 13 and 14 being omitted and a non-toothed conductor configuration 29 and 29' being used, in which case the conductive connections result from the fact that the conductor configurations 29 and 29' are in contact with the walls of the slots, be it that these solutions are not ideal.

The operation of the device is as follows. The electrical field lines of an E.M. oscillation of the type $TE_{10}$ occurring in the waveguide are perpendicular to the lower and the upper wall 19 and 20 of the waveguide, so they are situated in a plane of the drawing. An oscillation of this kind exhibits a maximum strength of the electrical field at the area of the substrate, so that this field is strongly coupled to the conductors 27 and 28. When the propagation direction of the oscillation is as denoted by an arrow 30 in the FIGS. 2 and 3, the field lines are displaced along the edges of the conductors 27 and 28 to the conductors 23 and 24 in that these conductors make further propagation in the waveguide impossible due to the halving of the waveguide width, the field lines then being shifted out of the plane of the drawing until they are perpendicular to the plane of the drawing between the conductors 23 and 24. Because of their direction, these fields are no longer coupled to possible interference fields in the waveguide. The field structure of this symmetrical conductor structure 23 and 24 is converted into that of the asymmetrical conductor structure 21, 22 by means of transformer 25, 26, 21, 22; for this purpose, the width of the conductor 23 at the area of the transformer should also be reduced to that of the strip-shaped conductor 21, with the result that the characteristic impedances of both conductor structures become equal. This impedance matching and field structure adaptation produce an optimum coupling between the band conductor structure and the microstrip conductor structure for which the reflection is very small over a wide frequency range; this is interalia due to the fact that the transformer has a high impedance with respect to the characteristic impedance of the two said conductor structures. The use of the symmetrical-asymmetrical transformer is notably important if RF energy is to be transformed from the microstrip conductor structure 21, 22 to the waveguide, because if such a transformer is not present, the microstrip conductor structure 21, 22 is not properly terminated, so that undesired reflections are liable to occur.

The pass-band attenuation $\alpha$ and the reflection coefficient $s$ have been measured as a function of the frequency for a waveguide microstrip conductor structure transition in series with an identical microstrip conductor waveguide structure transition. It was found that over the entire frequency range of from 17.5 GHz to 25 GHz the pass-band attenuation $\alpha$ is smaller than 0.5 dB and the reflection coefficient $s$ is then less than 1.22. The pass-band losses of 0.5 dB also include the loss which occurs in the microstrip conductor interconnecting the said two transitions.

It is to be noted that waveguides other than square waveguides, such as, for example, round waveguides can be used as long as in these waveguides oscillations are utilized having electrical field lines parallel to the substrate. The substrate 6 increases the capacitance between the lower wall and the upper wall 19 and 20 of the waveguide. This can be compensated for by choosing the height of the waveguide to be larger over the entire length of the substrate in dependence of the thickness of the substrate and the dielectric constant.

What is claimed is:

1. A microstrip to waveguide transition, comprising: a waveguide structure; a microstrip conductor structure including a substrate plate arranged in the longitudinal direction in the plane of symmetry and parallel to the electric field of the wave guide structure, an electrically balanced conductor structure including symmetrical conductor portions arranged on opposite sides of the substrate plate, an electrically unbalanced asymmetrical conductor structure including a conductive base plate and a strip-like conductor arranged on opposite sides of the substrate plate, said strip-like conductor being connected to the juxtaposed conductor portion and being reduced in width with respect thereto, and a symmetric-asymmetric transformer formed by two slots provided in said base plate on both sides of said strip-like conductor and in alignment with the edges of said conductor portions for interconnecting said symmetrical and asymmetrical conductor structures to provide an impedance match there-between and between the symmetrical structure to earth and between assymetrical structure to earth.

2. A microstrip to waveguide transition as claimed in claim 1, wherein the conductor portions of the symmetrical conductor structure form a band conductor which is arranged substantially in the longitudinal direction of the waveguide structure and connected at one end thereof to the symmetrical-asymmetrical transformer, and at the other end thereof, one of the conductor portions being coupled to one wall of the waveguide structure via a gradually broadening first conductor and the other conductor portion being coupled to an opposite waveguide wall via a gradually broadening second conductor.

3. A microstrip to waveguide transition as claimed in claim 2, wherein the substrate is clamped between slots provided in the waveguide wall portions, the broadening conductors extending on the substrate as far as the wall portions of the waveguide and being prolonged by a serrated conductor structure having a depth of teeth of approximately $\frac{1}{4}\lambda$ at the operating frequency, the serrated conductor structure being arranged in the slots and isolated from the wall portions.

* * * * *

UNITED STATES PATENT AND TRADEMARK OFFICE

CERTIFICATE OF CORRECTION

PATENT NO. : 4,052,683

DATED : October 4, 1977

INVENTOR(S) : JOHANNES H.C. VAN HEUVEN ET AL

It is certified that error appears in the above-identified patent and that said Letters Patent are hereby corrected as shown below:

Column 2, line 47, "29" should be --29'--

Column 3, line 18, "first" should be deleted line 19, should be rewritten as follows:

--conductor the first conductor portion 23 is connected-to be-- line 20, "14" should be --19--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*